US008091990B2

(12) United States Patent
Nelson et al.

(10) Patent No.: US 8,091,990 B2
(45) Date of Patent: Jan. 10, 2012

(54) CONTINUOUS PRINTHEAD CONTOURED GAS FLOW DEVICE

(75) Inventors: David J. Nelson, Rochester, NY (US); David L. Jeanmaire, Brockport, NY (US); Douglas E. Schultz, Dayton, OH (US); Joseph E. Yokajty, Webster, NY (US); Michael S. Hanchak, Dayton, OH (US); John C. Brazas, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 825 days.

(21) Appl. No.: 12/127,861

(22) Filed: May 28, 2008

(65) Prior Publication Data

US 2009/0295879 A1 Dec. 3, 2009

(51) Int. Cl.
*B41J 2/09* (2006.01)
*B41J 2/105* (2006.01)

(52) U.S. Cl. ..... 347/77; 347/82

(58) Field of Classification Search ..... 347/15, 347/77, 78, 82
See application file for complete search history.

(56) References Cited

U.S. PATENT DOCUMENTS

| | | | | |
|---|---|---|---|---|
| 3,596,275 | A * | 7/1971 | Sweet | 347/74 |
| 3,709,432 | A | 1/1973 | Robertson | |
| 4,068,241 | A | 1/1978 | Yamada | |
| 4,190,844 | A * | 2/1980 | Taylor | 347/82 |
| 6,457,807 | B1 | 10/2002 | Hawkins et al. | |
| 6,491,362 | B1 | 12/2002 | Jeanmaire | |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,588,888 | B2 | 7/2003 | Jeanmaire et al. | |
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 6,866,370 | B2 | 3/2005 | Jeanmaire | |
| 7,303,265 | B1 | 12/2007 | Delametter et al. | |
| 7,404,627 | B1 * | 7/2008 | Gao et al. | 347/77 |
| 7,517,066 | B1 * | 4/2009 | Gao et al. | 347/77 |
| 7,520,598 | B2 * | 4/2009 | Xu et al. | 347/77 |
| 7,669,988 | B2 * | 3/2010 | Sharma et al. | 347/77 |
| 7,682,002 | B2 * | 3/2010 | Brost et al. | 347/77 |
| 2007/0257971 | A1 | 11/2007 | Jeanmaire | |

FOREIGN PATENT DOCUMENTS

| | | | |
|---|---|---|---|
| EP | 1 228 874 | A1 | 8/2002 |
| EP | 1 277 581 | A2 | 1/2003 |
| EP | 1 366 902 | A1 | 12/2003 |

* cited by examiner

*Primary Examiner* — Charlie Peng
(74) *Attorney, Agent, or Firm* — William R. Zimmerli

(57) ABSTRACT

A continuous liquid printing system gas flow device includes a gas flow duct structure including a first wall and a second wall. The first wall and the second wall are positioned spaced apart and opposite each other to form an opening. The first wall is contoured such that a distance between the first wall and the second wall varies when viewed in a direction perpendicular to the opening.

9 Claims, 7 Drawing Sheets

CONTINUOUS PRINTHEAD CONTOURED GAS FLOW DEVICE

FIELD OF THE INVENTION

This invention relates generally to the field of digitally controlled printing devices, and in particular to continuous ink jet systems in which a liquid stream breaks into droplets that are deflected by a gas flow.

BACKGROUND OF THE INVENTION

Traditionally, digitally-controlled ink jet color printing is accomplished by one of two technologies. The first technology is commonly referred to as "drop on demand" (DOD) ink jet printing. The second technology is commonly referred to as "continuous stream" or "continuous" ink jet printing.

Continuous printing devices that deflect drops using a gas flow are known. U.S. Pat. No. 4,068,241 to Yamada, issued Jan. 10, 1978, entitled "Ink-jet recording device with alternate small and large drops," describes a printing device that uses a gas flow perpendicular to the drop trajectory to separate large drops and small drops formed by a printhead. The small drops are deflected more by the gas flow than the large drops. The large drops are collected by a catcher while the small drops were deflected past the catcher and allowed to strike a recording medium.

However, in continuous printing devices that use a gas flow, for example, an air flow, to deflect drops formed from an array of nozzles (commonly referred to as jets), several factors can combine to produce less deflection of the drops formed from nozzles located at the end(s) of the nozzle array. These factors include an overall reduction in air velocity near the ends of a rectangular shaped duct that delivers the air flow to the drops; how far the duct extends beyond the nozzle array (the width of the duct beyond the extent of the jets); and resistance of the drops formed from the nozzles of the array (commonly referred to as the jet curtain) to the air flow that effects air flow around the end(s) of the nozzle array. Less deflection of drops formed from the nozzles located at the end(s) of the nozzle array adversely affects drop placement of these drops on a print media (commonly referred to as a "bow effect").

As such, there is a need for an improved gas flow drop deflection device, a printhead including the same, and a method of printing including the same.

SUMMARY OF THE INVENTION

According to one aspect of the invention, a continuous liquid printing system gas flow device includes a gas flow duct structure including a first wall and a second wall. The first wall and the second wall are positioned spaced apart and opposite each other to form an opening. The first wall is contoured such that a distance between the first wall and the second wall varies when viewed in a direction perpendicular to the opening.

According to another aspect of the invention, a continuous liquid printhead includes a jetting module and a gas flow device. The jetting module includes an array of nozzles and is operable to form liquid drops having a first size and liquid drops having a second size through each nozzle. The gas flow device includes a structure to deflect the liquid drops having the first size and the second size. The structure includes a first wall and a second wall. The first wall and the second wall is positioned spaced apart and opposite each other to form an opening. The first wall is contoured such that a distance between the first wall and the second wall varies when viewed in a direction perpendicular to the opening.

According to another aspect of the invention, a method of printing includes providing a jetting module including an array of nozzles, the jetting module being operable to form liquid drops having a first size and liquid drops having a second size through each nozzle; providing a gas flow device including a structure to deflect the liquid drops having the first size and the second size, the structure including a first wall and a second wall, the first wall and the second wall being positioned spaced apart and opposite each other to form an opening, the first wall being contoured such that a distance between the first wall and the second wall varies when viewed in a direction perpendicular to the opening; providing a catcher; deflecting the liquid drops having a first size and the liquid drops having a second size formed from each nozzle of the array by causing a gas flow to flow through the gas flow device; collecting one of the liquid drops having a first size and the liquid drops having a second size using the catcher; and permitting the other of the liquid drops having a first size and the liquid drops having a second size to contact a print media.

BRIEF DESCRIPTION OF THE DRAWINGS

In the detailed description of the example embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

In the following description and drawings, identical reference signs have been used, where possible, to designate identical elements.

Figure 1A:
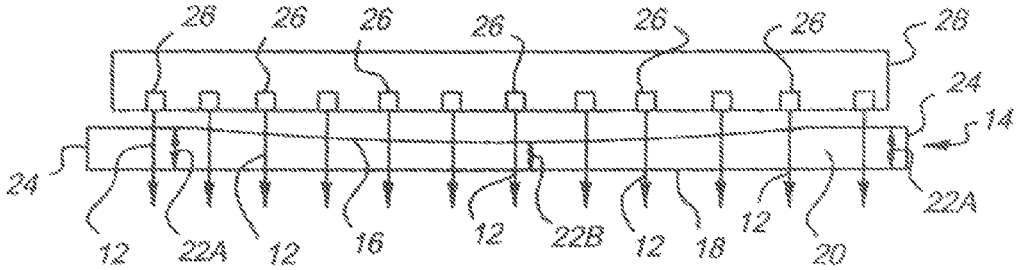
FIGS. 1A and 1B are schematic front views of an example embodiment of the present invention.
Figure 1B:
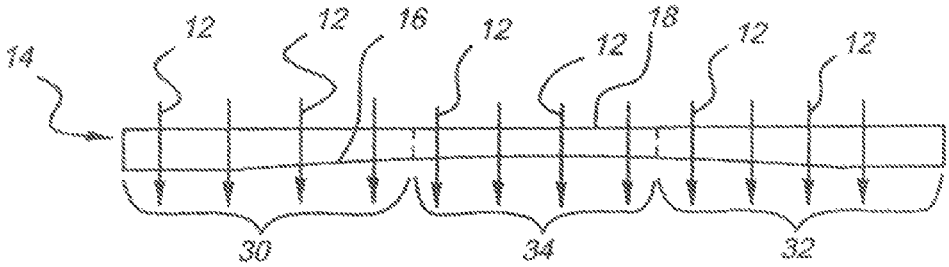

Referring to FIGS. 1A and 1B, example embodiments of a gas flow drop deflection device 10 for use in a continuous liquid printhead and printing system are shown. Gas flow device 10 includes a gas flow duct structure 14 which provides a gas flow, for example, a flow of air, that interacts with drops traveling along a path (represented by arrows 12) formed through an array of nozzles 26 of a jetting module 28.

Figure 2A:
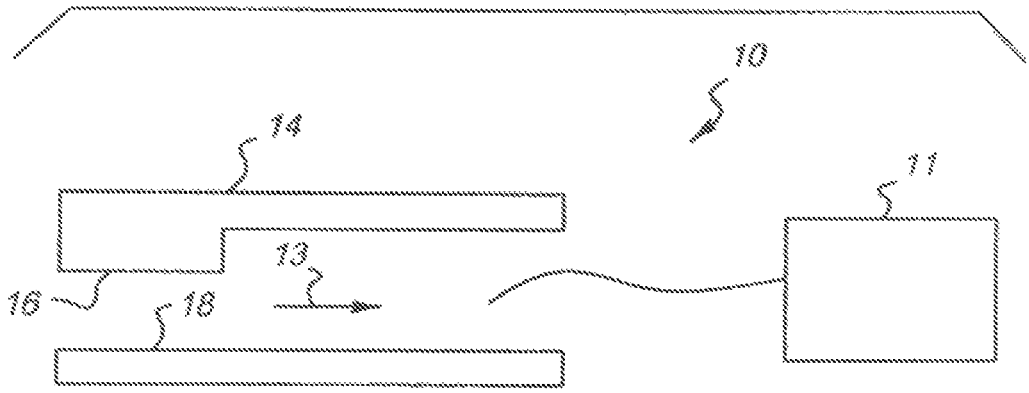
FIGS. 2A and 2B are schematic partial cross sectional side views of the example embodiment shown in FIG. 1A.
Figure 2B:
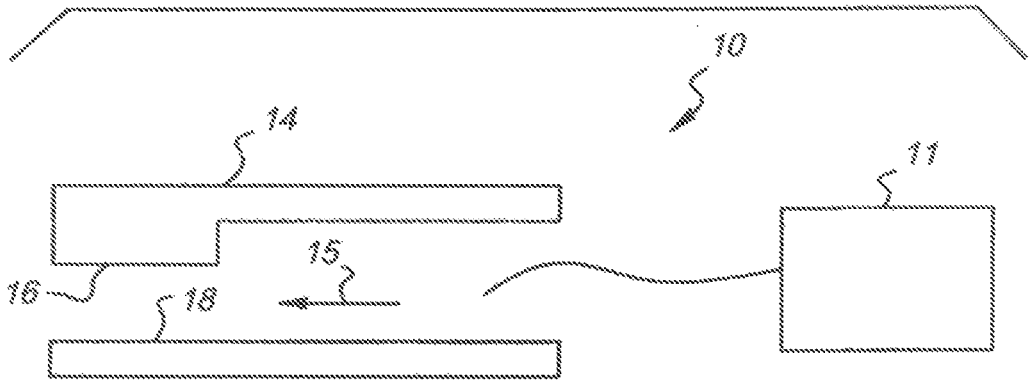

Referring to FIGS. 2A and 2B, the gas flow is generated by a gas flow source 11 of device 10 that is connected in fluid communication to gas flow duct 14. In FIG. 2A, gas flow source 11 is a source of negative pressure, for example, a vacuum source, that creates a negative pressure flow (represented by arrow 13) through gas flow duct structure 14 of gas flow device 10. In FIG. 2B, gas flow source 11 is a source of positive pressure, for example, a fan or blower, that creates a positive pressure flow (represented by arrow 15) through gas flow duct structure 14 of gas flow device 10. Alternatively, the gas flow can be created by a combination of positive pressure and negative pressure.

Referring back to FIGS. 1A and 1B, gas flow duct structure 14 of gas flow device 10 includes a first wall 16 and a second wall 18. First wall 16 and second wall 18 are positioned spaced apart and opposite each other to form an opening 20. First wall 16 is contoured. The contour of contoured first wall 16 (and second wall 18 in embodiments of the invention that include two contoured walls, described in more detail below) extends in a direction that is parallel to nozzle array 26 of jetting module 28 so that the distance between the first wall and the second wall varies when viewed along the contour in a direction perpendicular to opening 20. As such, a distance 22A, 22B between contoured first wall 16 and second wall 18 varies when viewed along the contour in a direction perpendicular to opening 20 (or perpendicular to the travel path 12 of the drops).

The contour of first wall 16 is linear as shown in FIGS. 1A and 1B. However, the contour of first wall 16 can be parabolic depending on the specific application contemplated for gas flow device 10. Second wall 18 is straight when viewed in a direction perpendicular to opening 20. Structure 14 also includes first and second side walls 24. First and second side walls 24 extend beyond the ends of nozzle array 26 of jetting module 28.

The contour of first wall 16 defines a first end portion 30, a second end portion 32, and a middle portion 34 of structure 14. Middle portion 34 is located between first end portion 30 and second end portion 32. Each of first end portion 30, second end portion 32, and middle portion 34 has an average distance between first wall 16 and second wall 18 of structure 14. The average distance between first wall 16 and second wall 18 of structure 14 in first end portion 30 and second end portion 32 is greater than the average distance between first wall 16 and second wall 18 of structure 14 in middle portion 34.

The contoured shape of first wall 16 can be achieved during manufacturing by, for example, forming or molding first wall 16 to include the desired contour shape. Alternatively, the contoured shape of first wall 16 can be achieved by beginning with a straight first wall 16 and either removing material from first end portion 30 and second end portion 32 of first wall 16 or adding material to middle portion 34 of first wall 16.

In FIG. 1A, contoured first wall 16 is located on an upstream side of structure 14 relative to jetting module 28 and drop travel path 12 while second wall 18 is located on a downstream side of structure 14. However, as shown in FIG. 1B, contoured first wall 16 is located on a downstream side of structure 14 relative to jetting module 28 while second wall 18 is located on an upstream side of structure 14. Typically, the location (upstream or downstream) of contoured first wall 16 depends on the specific application contemplated for gas flow device 10.

Figure 3:
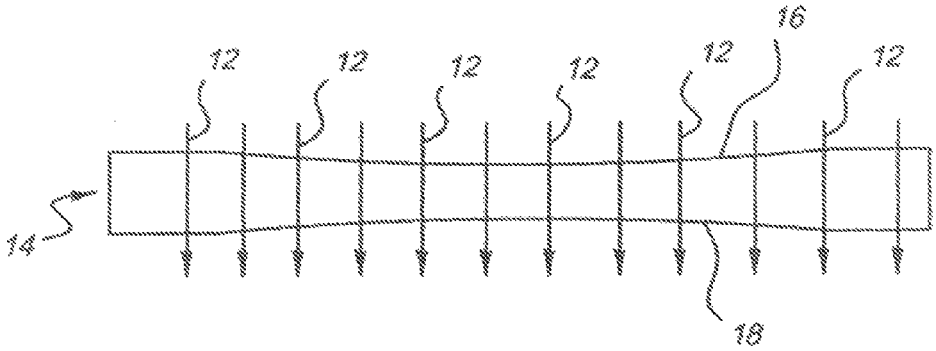
FIG. 3 is a schematic front view of another example embodiment of the present invention.

Referring to FIG. 3, another example embodiment of gas flow device 10 is shown. In this embodiment, first wall 16 is contoured. Second wall 18 is also contoured when viewed in a direction perpendicular to opening 20. In FIG. 3, the contour of second wall 18 is a mirror image of the contour of first wall 16. However, the contours of first wall 16 and second wall 18 can be different depending on the specific application contemplated for gas flow device 10.

Figure 4:
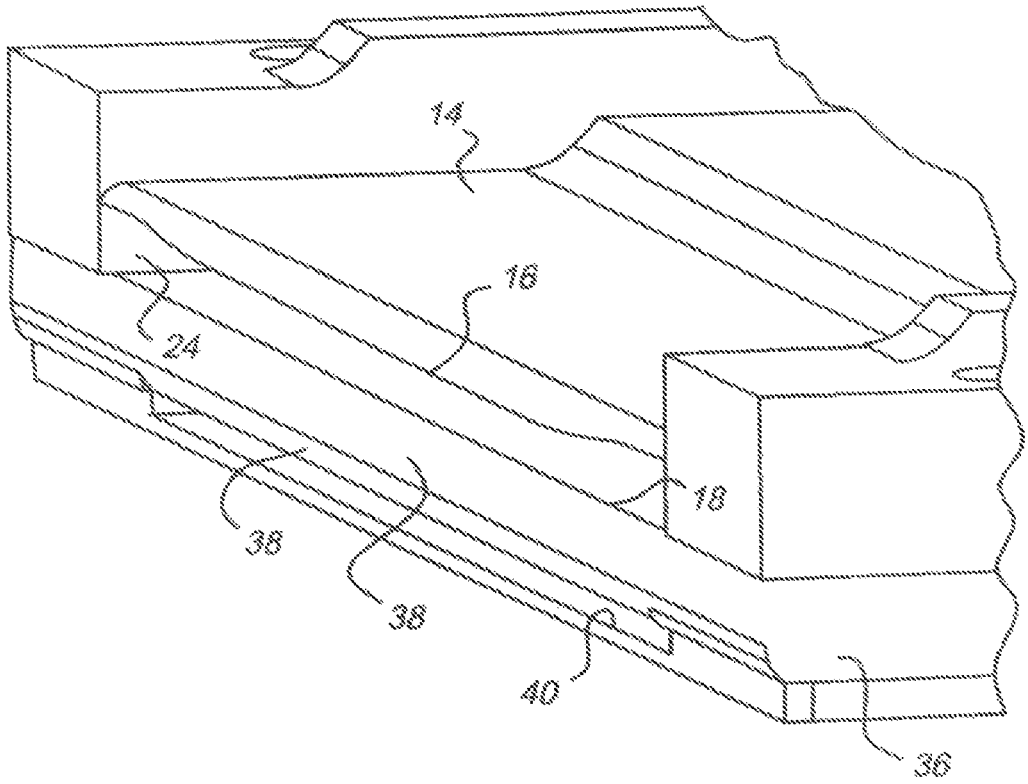
FIG. 4 is a schematic perspective view of another example embodiment of the present invention.

Referring to FIG. 4, structure 14 of gas flow device 10 is shown affixed to a catcher 36. Catcher 36, commonly referred to as a coanda type catcher or gutter, includes a face 38 and a liquid removal channel 40. During printing, non-printed liquid drops contact face 38 and then travel to liquid removal channel 40 for recycling or disposal 12. In FIG. 4, catcher 36 and structure 14 of gas flow device 10 share second wall 18 of structure 14 which helps to minimize the distance between jetting module 28 and a print media (shown in FIG. 5). Alternatively, catcher 36 and structure 14 can share contoured first wall 16. Typically, structure 14 is affixed to catcher 36 using adhesive and/or fasteners. However, structure 14 can be integrally formed to catcher 36.

Figure 5:
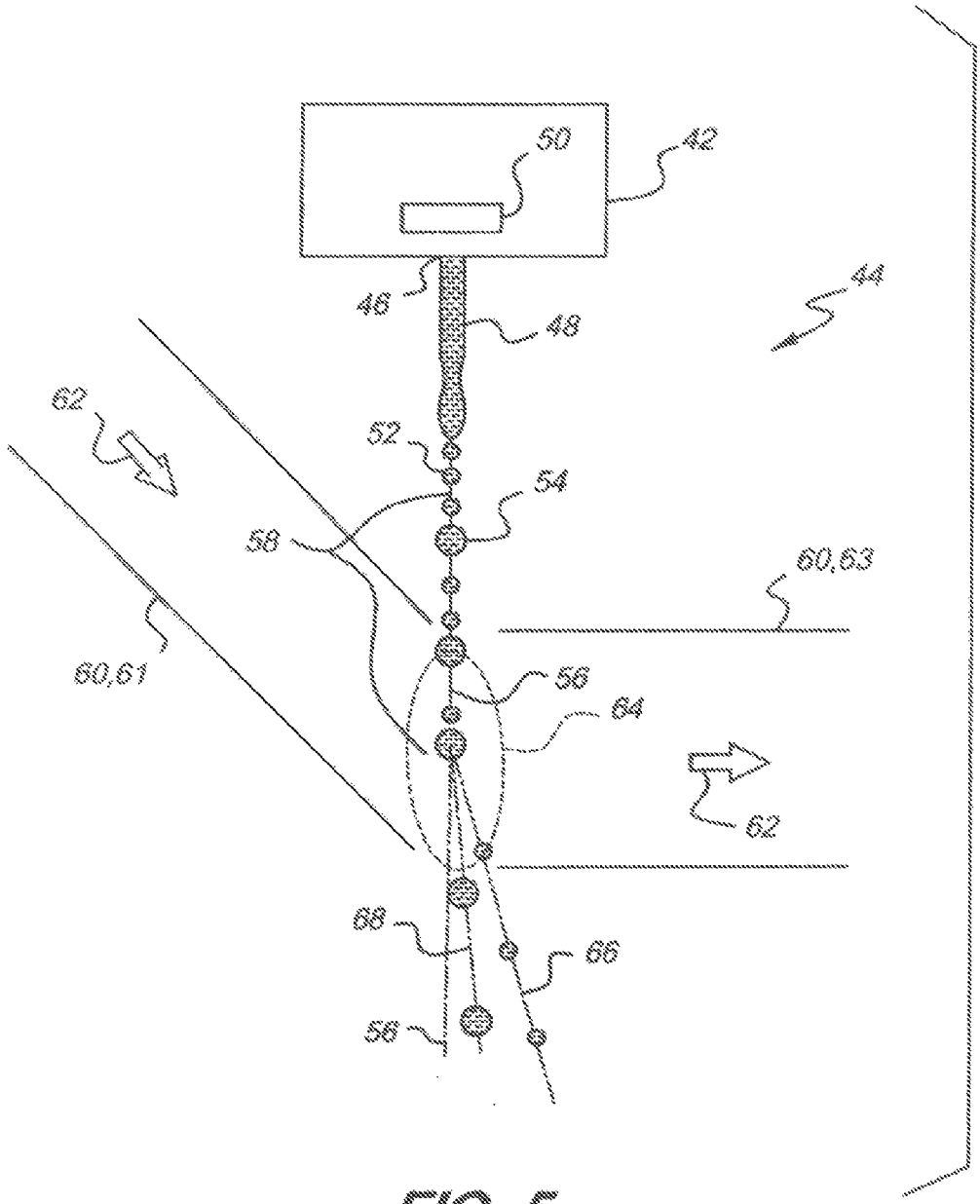
FIG. 5 is a schematic view of a continuous liquid printhead incorporating an example embodiment of the present invention.

Referring to FIG. 5, a schematic view of a continuous liquid printhead incorporating an example embodiment of the present invention is shown. A jetting module 42 of printhead 44 includes an array or a plurality of nozzles 46. Liquid, for example, ink, is emitted under pressure through each nozzle 46 of the array to form filaments of liquid 48. In FIG. 5, the array or plurality of nozzles extends into and out of the figure.

Jetting module 42 is operable to form liquid drops having a first size and liquid drops having a second size through each nozzle. In FIG. 5, jetting module 42 includes a drop stimulation or forming device 50, for example, a heater or a piezoelectric actuator, that, when activated, perturbs each filament of liquid 48, for example, ink, to induce portions of each filament to breakoff from the filament to form drops 52, 54. By selective activation of the drop forming device selective portions of the filament can break off and coalesce into drops 52, 54. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005, the disclosures of which are incorporated by reference herein.

Typically, drops 52, 54 are created in a plurality of sizes, for example, in the form of large drops 54, a first size, and small drops 52, a second size. The ratio of the mass of the large drops 54 to the mass of the small drops 52 is typically approximately an integer between 2 and 10. A drop stream 58 including drops 52, 54 follows a drop path or trajectory 56.

As shown in FIG. 5, a gas flow deflection mechanism 60 of printhead 44 includes a positive pressure gas flow structure 61 and a negative pressure gas flow structure 63. Either or both of positive pressure gas flow structure 61 and a negative pressure gas flow structure 63 includes gas flow duct structure 14 of gas flow device 10.

Gas flow deflection mechanism 60 directs a flow of gas 62, for example, air, past a portion of the drop trajectory 56. This portion of the drop trajectory is called the deflection zone 64. As the flow of gas 62 interacts with drops 52, 54 in deflection zone 64 it alters the drop trajectories. As the drop trajectories pass out of the deflection zone they are traveling at an angle, called a deflection angle, relative to the undeflected drop trajectory 56.

Small drops 52 are more affected by the flow of gas than are large drops 54 so that the small drop trajectory 66 diverges from the large drop trajectory 68. That is, the deflection angle for small drops 52 is larger than for large drops 54. The flow of gas 62 provides sufficient drop deflection and therefore sufficient divergence of the small and large drop trajectories so that a catcher (shown in FIGS. 6 and 7) can be positioned to intercept one of the small drop trajectory 66 and the large drop trajectory 68 so that drops following the trajectory are caught by the catcher while drops following the other trajectory bypass the catcher and impinge a print media (shown in FIGS. 6 and 7).

When the catcher is positioned to intercept large drop trajectory 68, small drops 52 are deflected sufficiently to avoid contact with the catcher and strike the print media. As the small drops are printed, this is called small drop print mode. When the catcher (shown in FIGS. 6 and 7) is positioned to intercept small drop trajectory 66, large drops 54 are the drops that print. This is referred to as large drop print mode.

Figure 6:
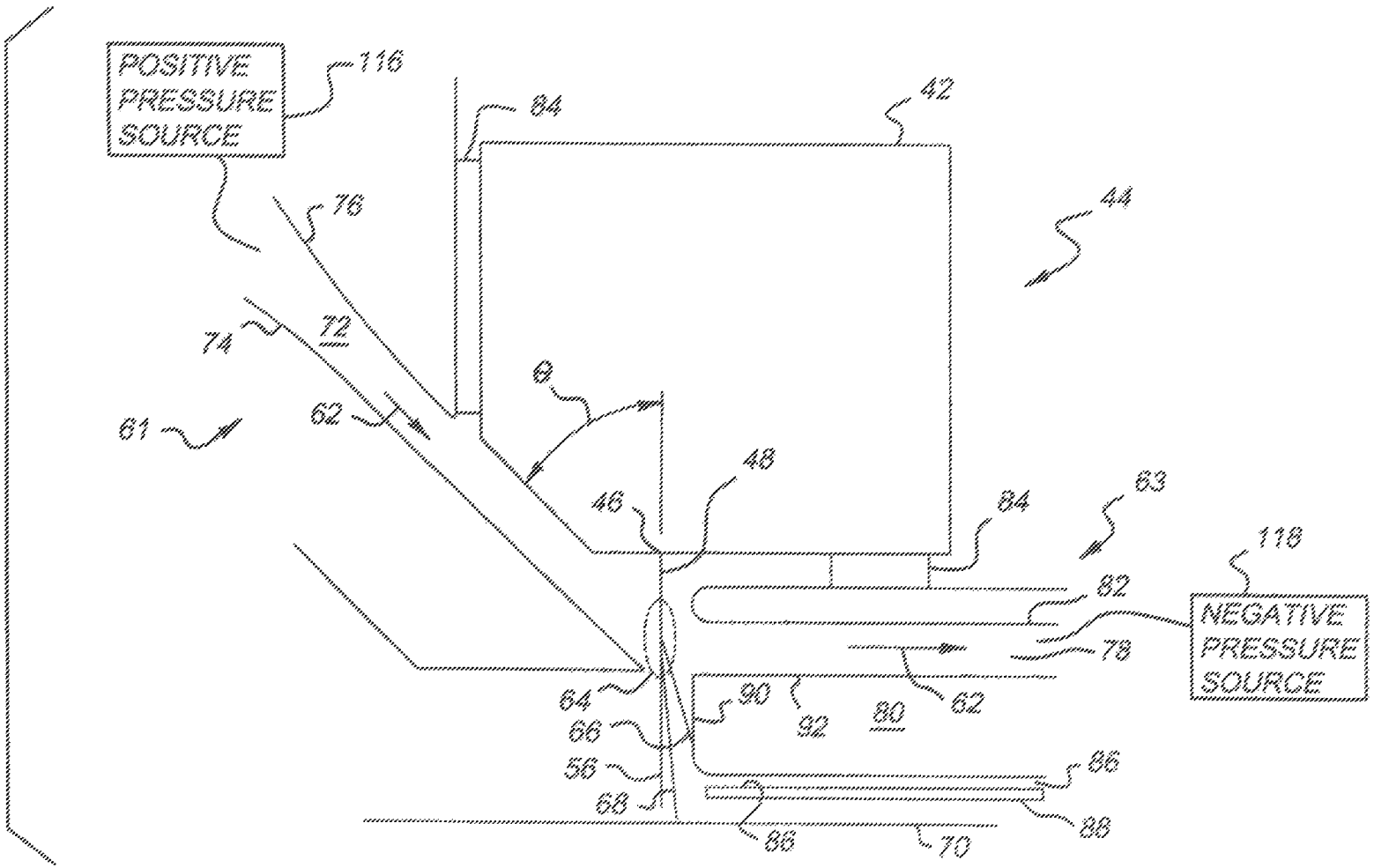
FIG. 6 is a schematic view of a continuous liquid printhead incorporating an example embodiment of the present invention.
Figure 7:
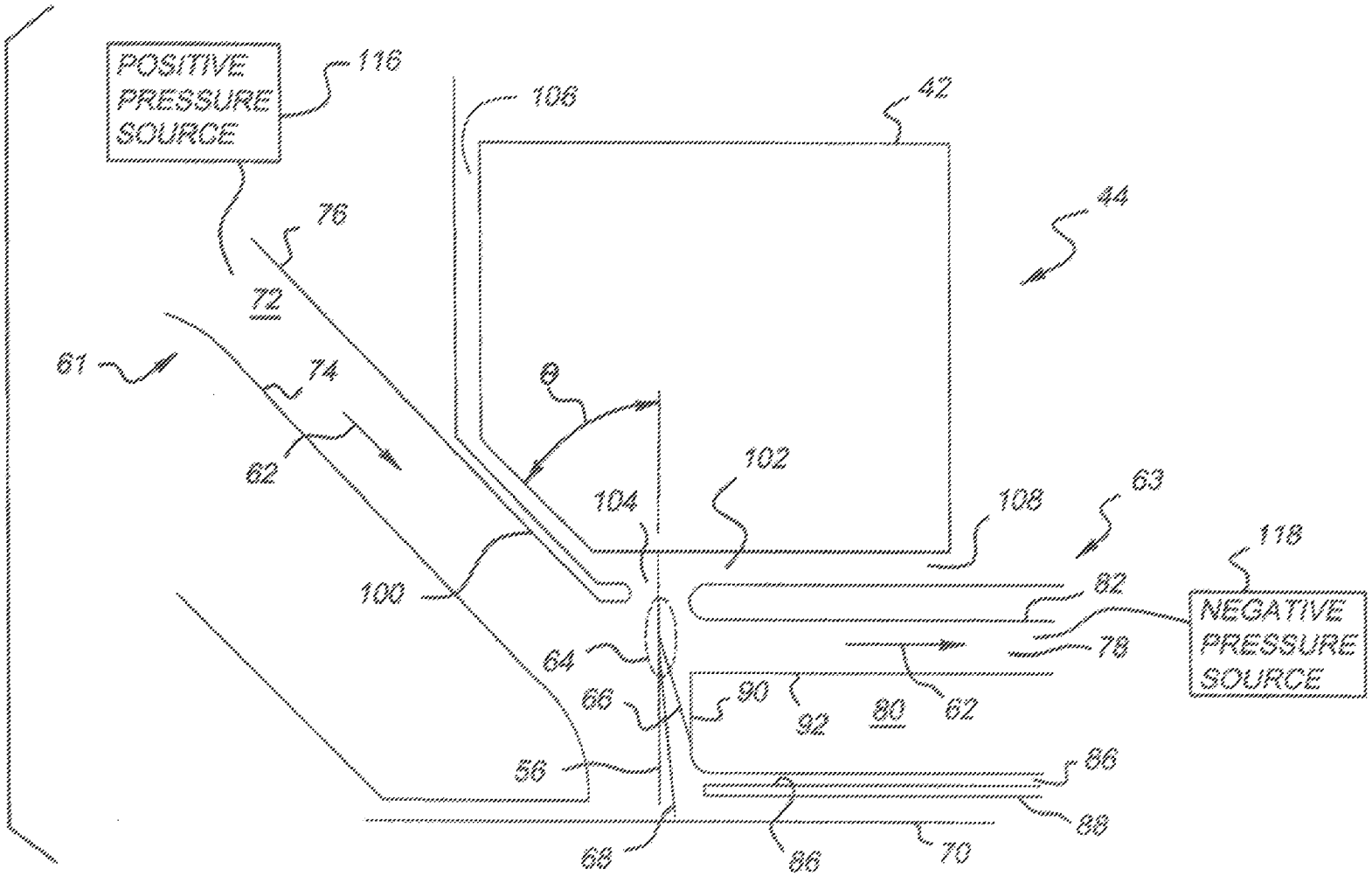
FIG. 7 is a schematic view of a continuous liquid printhead incorporating an example embodiment of the present invention.

Referring to FIGS. 6 and 7, and back to FIG. 5, jetting module 42 includes an array or a plurality of nozzles 46. Liquid, for example, ink, is emitted under pressure through each nozzle 46 of the array to form filaments of liquid 48. In FIGS. 6 and 7, the array or plurality of nozzles 46 extends into and out of each figure.

Stimulation device 50 (shown in FIG. 4) associated with jetting module 42 is selectively actuated to perturb the filament of liquid 48 to induce portions of the filament to break off from the filament to form drops. In this way, drops are selectively created in the form of large drops and small drops that travel toward a print media 70.

Positive pressure gas flow structure 61 of gas flow deflection mechanism 60 is located on a first side of drop trajectory 56. Positive pressure gas flow structure 61 includes first gas flow duct 72 that includes a lower wall 74 and an upper wall 76. Gas flow duct 72 directs gas supplied from a positive pressure source 116 at downward angle θ of approximately a 45° toward drop deflection zone 64. An optional seal(s) 84 provides an air seal between jetting module 42 and upper wall 76 of gas flow duct 72.

Negative pressure gas flow structure 63 of gas flow deflection mechanism 60 is located on a second side of drop trajectory 56. Negative pressure gas flow structure includes a second gas flow duct 78 located between a catcher 80 and an upper wall 82 that exhausts gas flow from deflection zone 64. Second duct 78 is connected to a negative pressure source 118 that is used to help remove air from second duct 78. An optional seal(s) 84 provides an air seal between jetting module 42 and upper wall 82. Second duct 78 can be connected to a negative pressure source 118 that is used to help remove air from second duct 78.

As described with reference to FIG. 5, gas supplied by first gas flow duct 72 is directed into the drop deflection zone 64, where it causes large drops 54 to follow large drop trajectory 68 and small drops 52 to follow small drop trajectory 66. In FIG. 6, small drop trajectory 66 is intercepted by a front face 90 of catcher 80. Small drops 52 contact face 38 and flow down face 90 and into a liquid return duct 86 located or formed between catcher 80 and a plate 88. Collected liquid is either recycled and returned to a fluid system (not shown) that provides liquid to printhead 44 or disposed as is known in the art. Large drops 54 bypass catcher 80 and travel on to print media 70.

In FIG. 6, either or both of positive pressure gas flow structure 61 and a negative pressure gas flow structure 63 includes gas flow duct structure 14 of gas flow device 10 depending on the specific application contemplated. Typically, it is preferred to incorporate gas flow device 10 with negative pressure gas flow structure 63. When this is done, gas flow device 10 can be affixed to a catcher 36, as shown in FIG. 4, to help to reduce the distance between jetting module 42 and print media 70. Reducing the distance between jetting module 42 and print media 70, in turn, helps to reduce print defects while still providing enough area in deflection zone 64 to achieve adequate drop deflection.

When gas flow duct structure 14 of gas flow device 10 is incorporated with negative pressure gas flow structure 63, upper wall 82 is contoured to form contoured first wall 16 of gas flow device 10. A wall 92 of catcher 80 that ends at front face 90 of catcher 80 forms second wall 18 of gas flow device 10. However, wall 92 can be contoured to form first wall 16 of gas flow device while upper wall 82 forms second wall 18 of gas flow device 10. Alternatively, both wall 92 of catcher 80 and upper wall 82 can be contoured.

Gas flow duct structure 14 of gas flow device 10 can be incorporated with positive pressure gas flow structure 61. As shown in FIG. 6, lower wall 74 is typically contoured because it ends proximate to deflection zone 64.

Referring to FIG. 7, positive pressure gas flow structure 61 of gas flow deflection mechanism 60 is located on a first side of drop trajectory 56. First gas flow duct 72 of positive pressure gas flow structure 61 includes a barrier wall 100 extending toward drop trajectory 56 from upper wall 76. An air plenum 102 is formed between jetting module 42 and barrier wall 100 and upper wall 82. A gap 104 exists between barrier wall 100 and upper wall 82. Drops ejected from jetting module 42 pass through gap 104. Air is supplied to plenum 102 via at least one of air ducts 106 and 108. If air is supplied by only one of the air ducts 106 and 108, a seal 84 (shown in FIG. 6) can be used to seal off the other duct. This supplied air exits the plenum 102 through gap 104. As this second air flow passes through the gap 104, it envelopes the drops and it flows approximately parallel to the drop trajectory as it is directed into the deflection zone. As a result, it reduces the air drag on the drops which might slow them down prior to reaching the deflection zone.

In FIG. 7, either or both of positive pressure gas flow structure 61 and a negative pressure gas flow structure 63 includes gas flow duct structure 14 of gas flow device 10 depending on the specific application contemplated. Typically, it is preferred to incorporate gas flow device 10 with negative pressure gas flow structure 63. When this is done, gas flow device 10 can be affixed to a catcher 36, as shown in FIG. 4, to help to reduce the distance between jetting module 42 and print media 70. Reducing the distance between jetting module 42 and print media 70, in turn, helps to reduce print defects while still providing enough area in deflection zone 64 to achieve adequate drop deflection.

When gas flow duct structure 14 of gas flow device 10 is incorporated with negative pressure gas flow structure 63, upper wall 82 is contoured to form contoured first wall 16 of gas flow device 10. A wall 92 of catcher 80 that ends at front face 90 of catcher 80 forms second wall 18 of gas flow device 10. However, wall 92 can be contoured to form first wall 16 of gas flow device while upper wall 82 forms second wall 18 of gas flow device 10. Alternatively, both wall 92 of catcher 80 and upper wall 82 can be contoured.

Gas flow duct structure 14 of gas flow device 10 can be incorporated with positive pressure gas flow structure 61. As shown in FIG. 7, barrier wall 100 is typically contoured because it ends proximate to deflection zone 64. However, in other configurations of positive pressure gas flow structure 61 either or both of lower wall 74 and barrier wall 100 can be contoured because each wall ends proximate to deflection zone 64.

Figure 8:
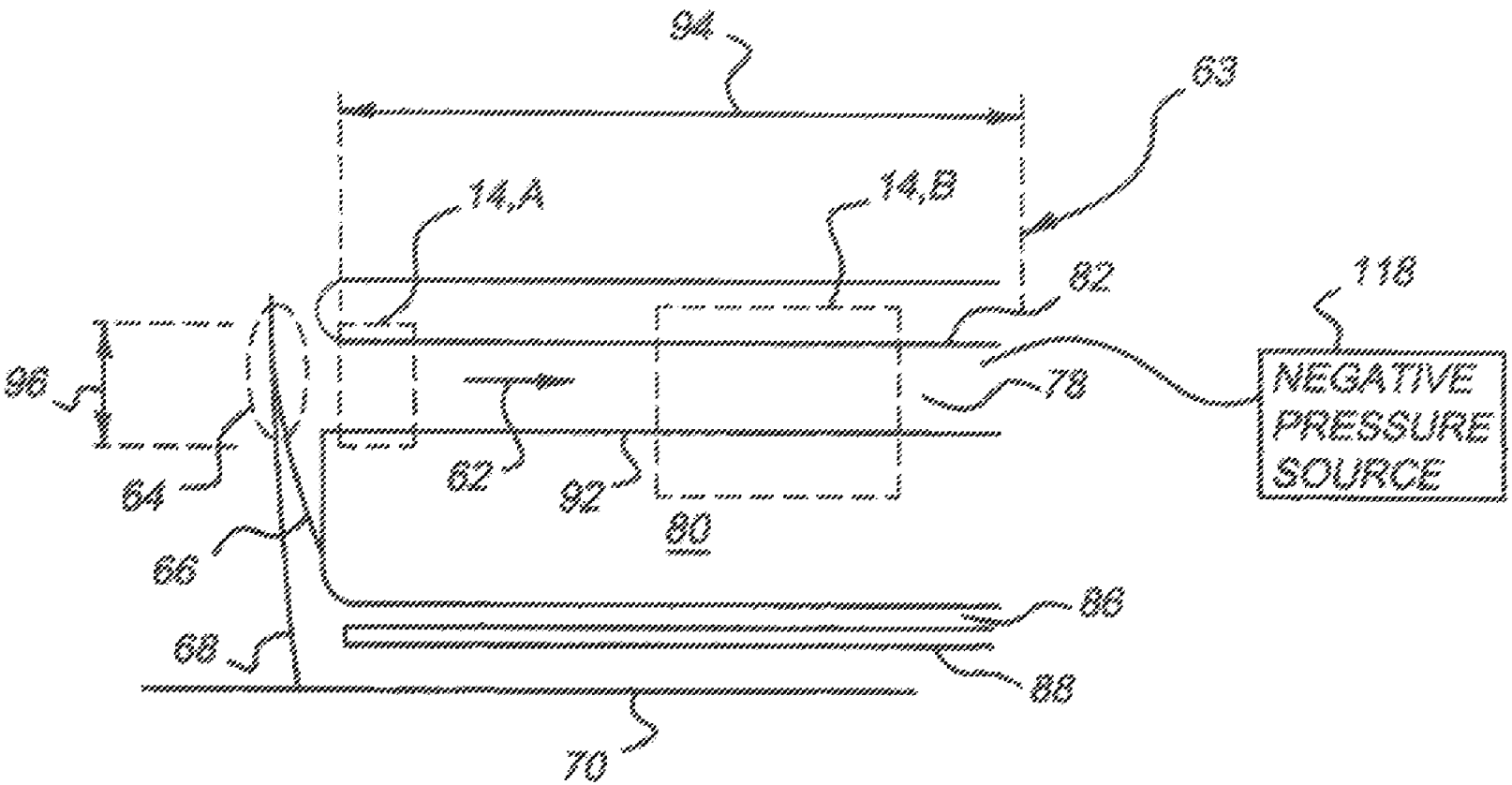
FIG. 8 is a schematic view of a portion of a continuous liquid printhead incorporating an example embodiment of the present invention.

Referring to FIG. 8, negative pressure gas flow structure 63 and catcher 80 are shown. Gas flow duct structure 14 can be positioned anywhere along the length 94 of negative pressure gas flow structure 63. Length 94 is perpendicular to nozzle array 46 of jetting module 42. However, for purposes of clarity, gas flow duct structure 14 (represented by dashed lines) is shown in two locations A and B in FIG. 8. Location A is adjacent or proximate to deflection zone 64. Location B is removed from deflection zone 64.

Gas flow duct structure 14 is dimensioned differently depending on its position along negative pressure gas flow structure 63. When gas flow duct structure 14 is positioned in location A, gas flow duct 14 is shorter in length 94 and not as tall in height 96 when compared to gas flow duct structure 14 that is positioned in location B. When positioned in location A, gas flow duct structure 14 creates a larger deflection area and increases gas flow velocity for drops formed from nozzles located at the end of nozzle array. However, when positioned in location B, gas flow duct 14 only increases gas flow velocity for drops formed from nozzles located at the end of nozzle array. Accordingly, when positioned in location A, gas flow duct structure 14 does not need to be as long and/or as tall as it does when positioned in location B along negative pressure gas flow structure 63.

Referring back to FIGS. 1-8, the contour of contoured first wall 16 (and second wall 18 in embodiments of the invention that include two contoured walls) of gas flow duct structure 14 extends in a direction that is parallel to nozzle array 26. This creates an opening 20 that is wider at both ends than it is in the middle. This duct structure 14 shape increases the liquid drop gas flow interaction area at the ends of structure 14, and increases the velocity and amount of gas flow in these end regions (when compared to conventional gas flow ducts). This, in turn, increases the amount of drop deflection of drops formed from nozzles at the end of nozzle array 26 which improves the drop placement of drops formed from nozzles located at the ends of nozzle array 26. Overall, the uniformity of drop placement straightness on either the catcher face 90 for non-printed drops or the print media 70 for printed drops is improved and the "bow effect" of these drops is reduced or at least partially corrected.

In addition to the "bow effect" another phenomenon can effect where the jets hit on the paper. In continuous inkjet printing systems, the end jets have a tendency to slow down such that as the paper is traveling beneath them, the time at which they impact the paper can also effect drop placement. It is understood that the invention as described can be used to also correct for this effect by increasing or decreasing the spatial position of the end jets to compensate for the timing differences (at a given paper speed).

Print margin is defined as the maximum deviation in position where the catcher needs to be located to collect all of the unwanted catch drops and allow all of the print drops to pass. It is at most the difference in deflection between the large and small drops and is further reduced by a variety of factors such as ink film thickness on the catcher surface, any non-uniformities in mechanical straightness, and any deflection non-uniformities. If the compensation as described in the previous paragraph is implemented, it must be expected that the impact of the catch drops onto the catcher may not be optimized for best print margin (perfectly horizontal across the entire width of the catcher). Any deviation from a horizontal catch line will degrade print margin. The methods and apparatus described in this invention can be used to produce a flat impact line on the catcher, or a horizontal line of drops on the paper, or a compromised position in between.

The invention has been described in detail with particular reference to certain preferred embodiments thereof, but it will be understood that variations and modifications can be effected within the scope of the invention.

PARTS LIST

10 gas flow device
11 gas flow source
12 travel path arrows
13 negative pressure flow arrow
14 gas flow duct structure
15 positive pressure flow arrow
16 first wall
18 second wall
20 opening
22A distance
22B distance
24 side walls
26 nozzles
28 jetting module
30 first end portion
32 second end portion
34 middle portion
36 catcher
38 face
40 liquid removal channel
42 jetting module
44 printhead
46 plurality of nozzles
48 liquid
50 device
52 drops
54 large drops
56 trajectory
58 drop stream
60 gas flow deflection mechanism
61 positive pressure gas flow structure
62 gas
63 negative pressure gas flow structure
64 drop deflection zone
66 small drop trajectory
68 large drop trajectory
70 print media
72 first gas flow duct
74 lower wall
76 upper wall
78 second gas flow duct
80 catcher
82 upper wall
84 seal
86 liquid return duct
88 plate
90 front face
92 wall
94 length
96 height
100 barrier wall
102 air plenum
104 gap
106 at least one of air ducts
108 at least one of air ducts
116 positive pressure source
118 negative pressure source

The invention claimed is:

1. A continuous liquid printhead comprising:

a jetting module including an array of nozzles, the jetting module being operable to form liquid drops having a first size and liquid drops having a second size through each nozzle; and a gas flow device including a structure to deflect the liquid drops having the first size and the second size, the structure including a first wall and a second wall, the first wall and the second wall being positioned spaced apart and opposite each other to form an opening, the first wall being contoured such that a distance between the first wall and the second wall varies when viewed in a direction perpendicular to the opening, the contour of the first wall extending in a direction that is parallel to the nozzle array, and the contour of the first wall defining a first end portion, a second end portion, and a middle portion located between the first end portion and the second end portion, each of the first end portion, the second end portion, and the middle portion having an average distance between the first wall and the second wall of the structure, wherein the average distance between the first wall and the second wall of the structure in the first end portion and the second end portion is greater than the average distance between the first wall and the second wall of the structure in the middle portion.

2. The printhead of claim 1, further comprising:

a catcher positioned to collect one of the drops having the first size and the drops having the second size, wherein the gas flow device is positioned between the jetting module and the catcher.

3. The printhead of claim 2, wherein the catcher and the gas flow device share one of the first wall and the second wall.

4. The printhead of claim 1, further comprising:

a source of negative pressure connected in fluid communication with the structure of the gas flow device.

5. The printhead of claim 1, wherein the first wall is positioned closer to the jetting module than the second wall.

6. The printhead of claim 1, wherein the second wall is positioned closer to the jetting module than the first wall.

7. The printhead of claim 1, wherein the second wall is straight when viewed in a direction perpendicular to the opening.

8. The printhead of claim 1, wherein the second wall is also contoured when viewed in a direction perpendicular to the opening.

9. A method of printing comprising:

providing a jetting module including an array of nozzles, the jetting module being operable to form liquid drops having a first size and liquid drops having a second size through each nozzle;

providing a gas flow device including a structure to deflect the liquid drops having the first size and the second size, the structure including a first wall and a second wall, the first wall and the second wall being positioned spaced apart and opposite each other to form an opening, the first wall being contoured such that a distance between the first wall and the second wall varies when viewed in a direction perpendicular to the opening, the contour of the first wall extending in a direction that is parallel to the nozzle array, and the contour of the first wall defining a first end portion, a second end portion, and a middle portion located between the first end portion and the second end portion, each of the first end portion, the second end portion, and the middle portion having an average distance between the first wall and the second wall of the structure, wherein the average distance between the first wall and the second wall of the structure in the first end portion and the second end portion is greater than the average distance between the first wall and the second wall of the structure in the middle portion;

providing a catcher;

deflecting the liquid drops having a first size and the liquid drops having a second size formed from each nozzle of the array by causing a gas flow to flow through the gas flow device;

collecting one of the liquid drops having a first size and the liquid drops having a second size using the catcher; and permitting the other of the liquid drops having a first size and the liquid drops having a second size to contact a print media.

* * * * *